US007293300B2

(12) United States Patent
Kunkel

(10) Patent No.: US 7,293,300 B2
(45) Date of Patent: Nov. 13, 2007

(54) TRICKLE WATERFALL FOR SPA

(75) Inventor: Richard Kunkel, Murrieta, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 303 days.

(21) Appl. No.: 10/828,905

(22) Filed: Apr. 21, 2004

(65) Prior Publication Data

US 2005/0235407 A1 Oct. 27, 2005

(51) Int. Cl.
*E04H 4/12* (2006.01)

(52) U.S. Cl. ..... 4/507; 4/496; 239/20

(58) Field of Classification Search ..... 4/507, 4/678, 489, 506, 541.1, 591; 239/18, 20
See application file for complete search history.

(56) References Cited

U.S. PATENT DOCUMENTS 3,579,667 A * 5/1971 Giglio ..... 4/591
4,823,409 A * 4/1989 Gaffney et al. ..... 4/678
4,881,280 A * 11/1989 Lesikar ..... 4/507
5,415,221 A * 5/1995 Zakryk ..... 165/283
5,608,927 A * 3/1997 Lowry et al. ..... 4/507 X
6,152,381 A * 11/2000 Hones ..... 239/17
6,210,568 B1 4/2001 Harder ..... 4/507 X
6,484,952 B2 * 11/2002 Koren ..... 239/18
2005/0155144 A1 * 7/2005 McDonald et al. ..... 4/507

* cited by examiner

*Primary Examiner*—Robert M. Fetsuga

(57) ABSTRACT

A waterfall for a portable spa does not take up any seat space by being set into the top rim of the spa. Water from the spa circulation system flows into a closed end of a channel located in the top rim and along the channel to the open end located at the edge of the top rim on the inside wall to fall into the body of water in the spa. A light source at the point where the water enters the closed end of the channel, which may be adapted to change colors, directs light into the water flow, lighting the water that falls into the spa, in different colors, as desired.

8 Claims, 4 Drawing Sheets

TRICKLE WATERFALL FOR SPA

BACKGROUND OF THE INVENTION

1. Field of the Invention

The present invention relates generally to improvements in portable spas, and more particularly, pertains to new and improved water features for a portable spa wherein a waterfall is provided as part of the portable spa for the enjoyment and entertainment of the spa users.

2. Description of Related Art

In the field of portable spas, manufacturers are continually trying to enhance the portable spa product by adding various entertainment features to it beyond the hot water and jet massaging functions. Manufacturers have added audio systems to a portable spa device. Some manufacturers have added water features, such as waterfalls, to portable spa devices. The problem associated with the inclusion of a waterfall in a portable spa is the amount of space required by the waterfall. The present invention overcomes this problem.

SUMMARY OF THE INVENTION

A channel with a closed end and an open end is set into the top rim of a portable spa with the open end of the channel located at the edge of the top rim on the inside wall. Water is fed into the channel at the closed end so that it flows over a light source, picking up light energy. The water flows in laminar fashion along the channel embedded in the top rim guided by flow ribs located along the channel floor. A disrupter button on the channel floor at the open end disturbs the laminar flow, causing the light in the water flow to be reflected and become more visible as it falls into the main water body in the spa.

BRIEF DESCRIPTION OF THE DRAWINGS

The objects and advantages of the present invention will become readily apparent upon consideration of the following detailed description in conjunction with the accompanying drawings in which like reference numerals designate like parts throughout the figures thereof and wherein.

DETAILED DESCRIPTION OF THE PREFERRED EMBODIMENTS

Figure 1:
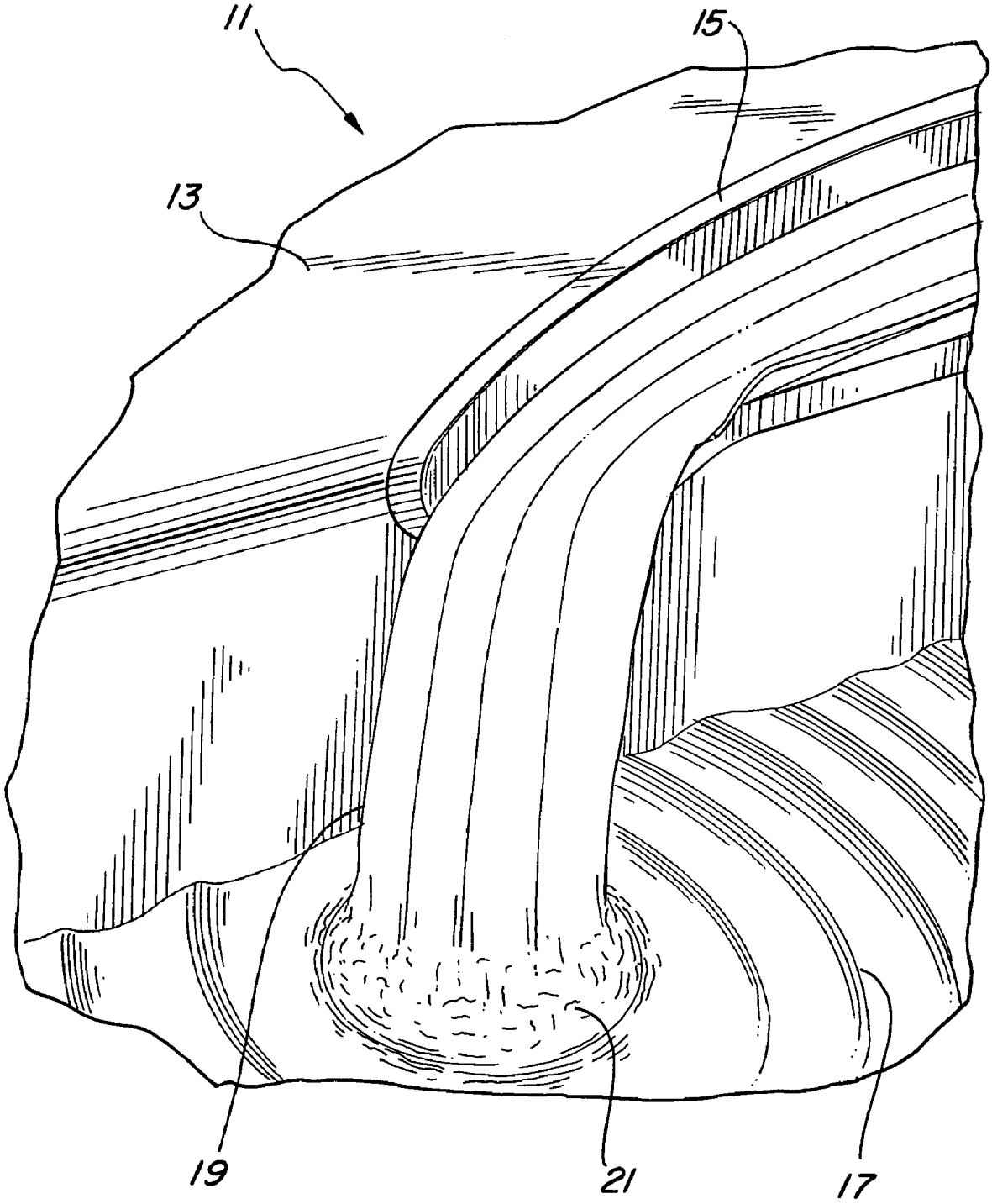
FIG. 1 is a perspective illustration of a preferred embodiment of the present invention.

The waterfall feature 11 of the present invention which is preferably constructed of all plastic parts, as seen in FIG. 1, is located in the top rim 13 of the portable spa with the water flow channel 15 embedded in and conforming to the top rim 13 of the spa. Water 19 falls from the channel 15 at the inside edge of the spa rim into the main water body 17 of the spa with a splash 21, causing light reflection from the flow and the splash, if the water flow 19 is lighted in a manner hereinafter described.

Figure 2:
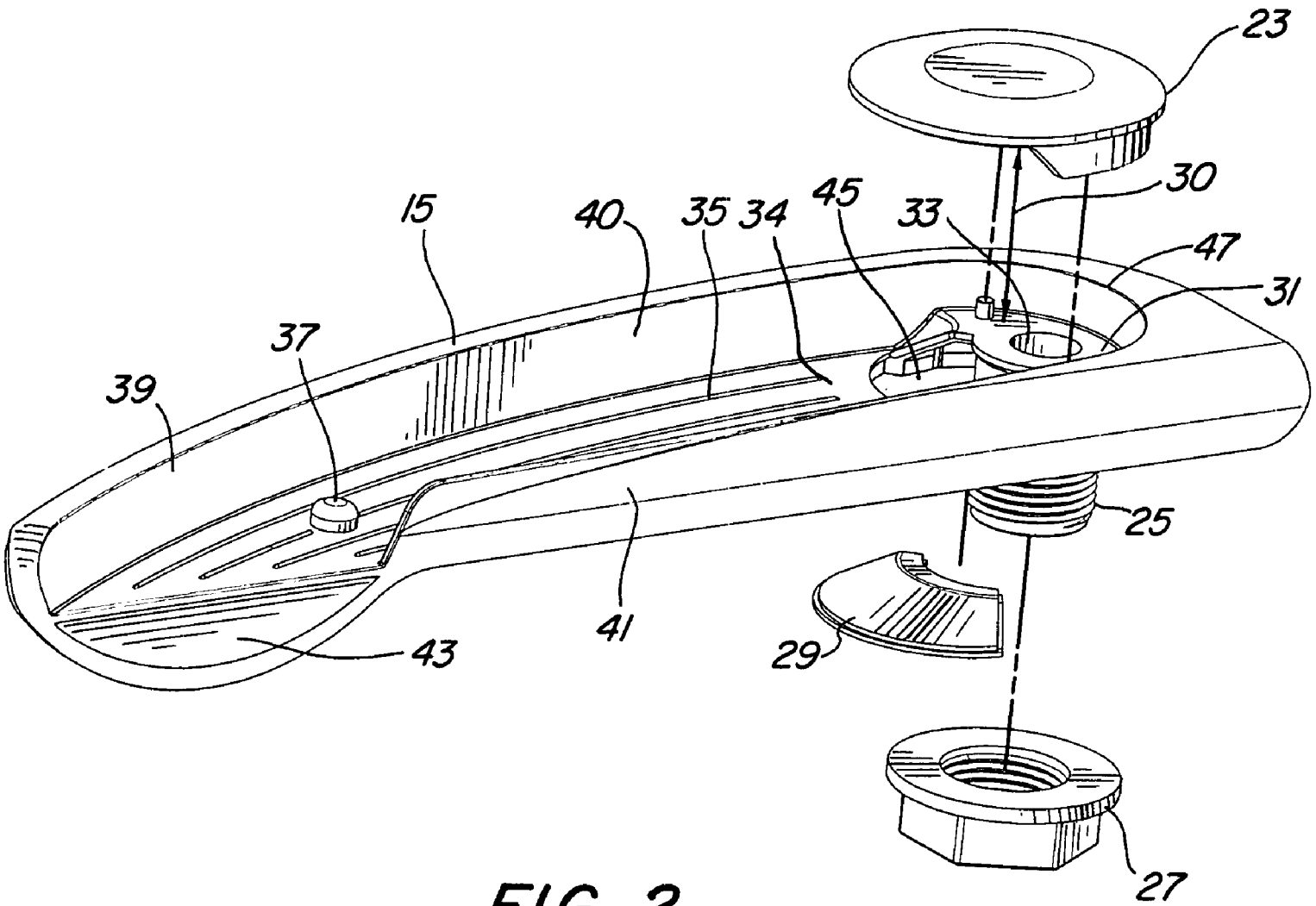
FIG. 2 is an assembly drawing of the waterfall of FIG. 1.

FIG. 2 illustrates the basic parts of a preferred embodiment of the present invention. The channel 15 of the waterfall is shown as having an open end 39 and a closed end 47 with walls 41 defining a channel of flow for water entering channel 15 at an access aperture 33 in a platform 31 at the closed end 47 of channel 15. Aperture 33 connects to a threaded coupling 25 on which a pipe coupling nut 27 may be threaded to connect the aperture 33 to the water circulation system of the portable spa.

The bottom 34 of channel 15 has a plurality of ribs 35 extending from the closed end 47 to the open end 39. The water flow entering at aperture 33 at the closed end 47 flows towards the open end 39 in a quiet laminar manner because of the ribs 35. A disruptor button 37 located at the open end 39 of channel 15 disturbs the water flow at the open end 39 just before the water spills over lip 43 of channel 15 into the main body of water of the portable spa (not shown). The disruptor button 37 creates enough turbulence in the water flow at that point to cause the light energy in the water to be reflected out of the water flow and thereby become more visible to the human eye.

A cap 23 of unique construction, as will be explained hereinafter, with a skirt 49 around its back side snaps onto studs 55 over aperture 33 on the platform 31, thereby forming an inlet chamber 30 having a directional opening that directs the water flow towards the open end 39 of channel 15. An aperture 45 located in the platform 31 and bottom 34 of channel 15 is closed by a lens ramp 29 constructed in a manner as will be described hereinafter. The lens 29 is located at the flow output of the inlet chamber so that the flow is over the lens and light from the other side of the lens is injected into the water flow, as it leaves the inlet chamber. The light source (not shown) may be of any convenient structure. The use of CFD's of various colors, however, is particularly suited for this application.

Figure 3:
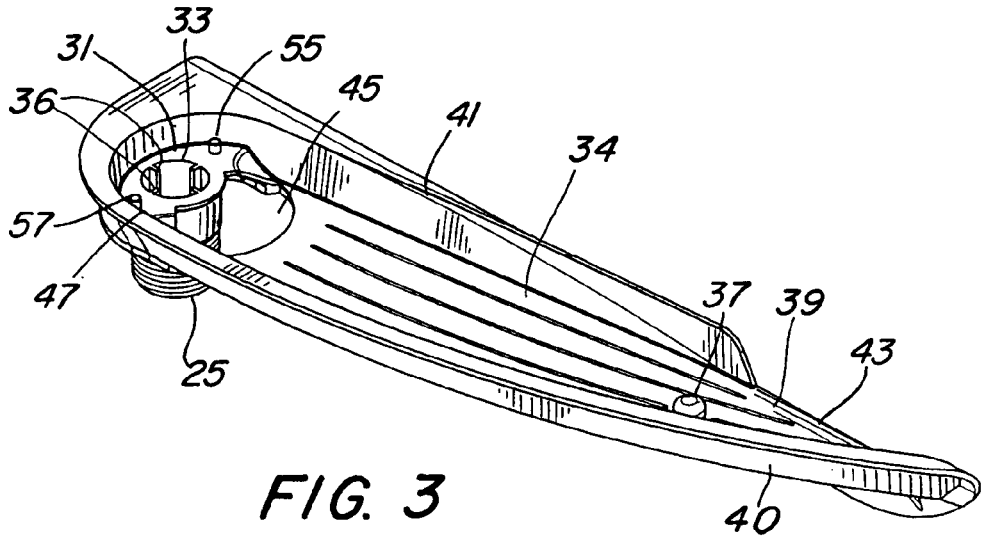
FIG. 3 is a top perspective of the channel of the waterfall of FIG. 1.

FIG. 3 illustrates more clearly the channel wall structure 40 and 41 and floor 34 of the channel 15 that guides the water between the closed end 47 and the open end 39. It should be remembered that this entire structure is located in the top rim a portable spa. The upper walls are preferably flush with the top rim. The platform 31 at the closed end 47 of the channel is raised above the floor 34 of the channel 15 so as to create a drop in height between the platform 31 and the floor 34. An aperture 45 is located between the platform level 31 and floor 34 in the flow path. The aperture is filled by a lens ramp 29 of a construction as will hereinafter be described. The water that comes in the chamber at aperture 33 in platform 31 gets accelerated slightly when it flows down the incline formed by the lens ramp 29 in aperture 45. Besides accelerating slightly, the water flow picks up light energy passing through the lens from the other side.

Figure 4:
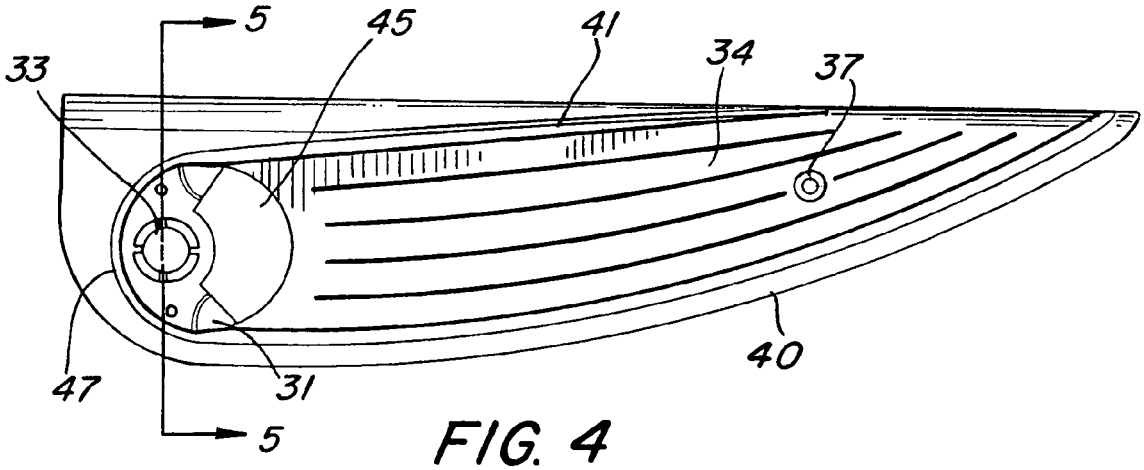
FIG. 4 is a top plan view of the channel of FIG. 3.

As can be seen in FIG. 4, the shape of the channel 15 is unique in that the wall 41 at the inside water edge of the top rim is thicker and straight, while the wall 40 at the outside edge of the top rim is curved. This shape provides a very aesthetically pleasing water flow channel that fits within the confines of the top rim of the portable spa.

Figure 5:
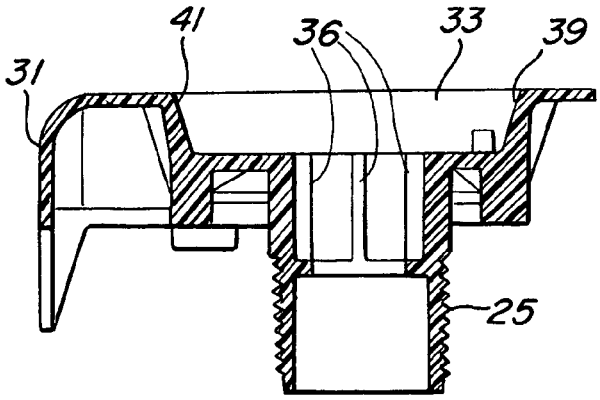
FIG. 5 is a cross-section taken along line 5-5 of FIG. 4 looking in the direction of the arrows.

As can be seen in FIG. 5, the threaded stud 25 empties directly into the aperture 33 in platform 31. Located in aperture 33 is a plurality of water flow guides 36 which tend to quiet the turbulent flow entering attachment stud 25, into more laminar flow that exits aperture 33 and fills the chamber above platform 31, before flowing down lens ramp 29, picking up light energy on its way.

Figure 6:
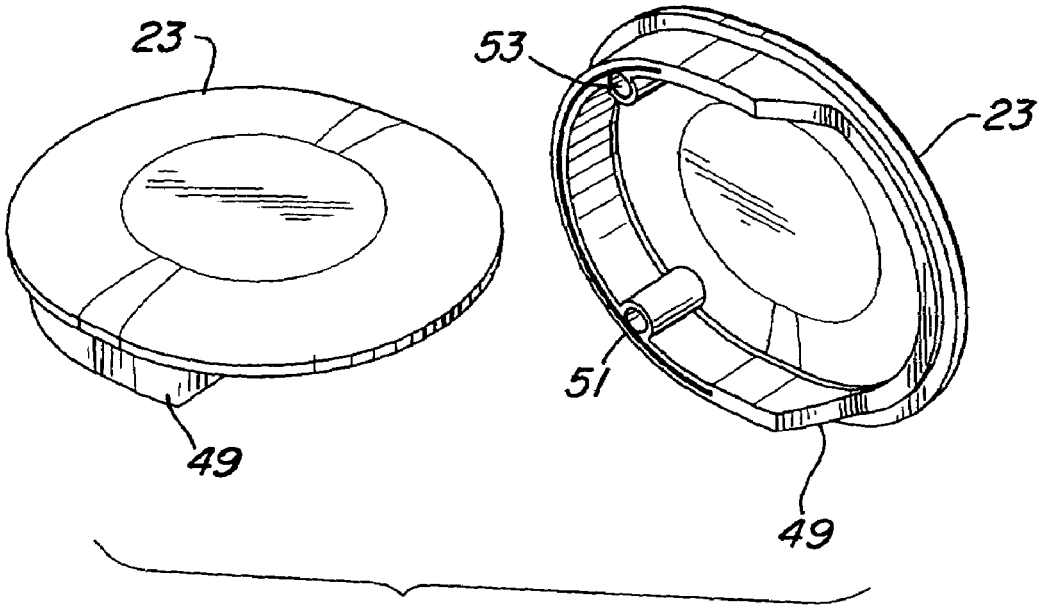
FIG. 6 is a top and bottom perspective of a top cap for the waterfall of FIG. 1.
Figure 7:
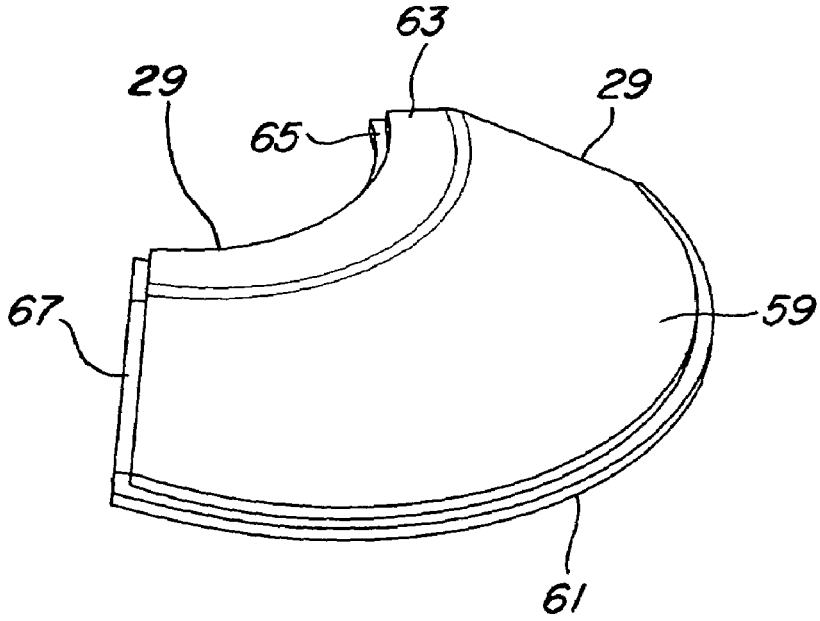
FIG. 7 is a perspective of the lens used in the channel of the waterfall of FIG. 1.

FIG. 6 illustrates in greater detail the cap 23 which fits over the aperture 33 in the raised platform 31 at the closed end of flow channel 15. Cap 23 has a skirt 49 that extends around the perimeter, except for a short distance of the perimeter, which allows water to flow out of the chamber. The skirt 49 has a pair of columns with apertures 51 and 53 therein, respectively, that fit into studs 57 and 55 (FIG. 3). The skirt 49 of the cap 23 is glued to the platform 31, thereby creating a chamber which has only one egress for the water entering at aperture 33 in platform 31.

The lens ramp 29 which fits into aperture 45 of the water flow channel is built to have a ledge 65 at its concave back side, a ledge 61 at its convex front side, and ledges 67 between the front and back sides, so that the ramp easily snaps into the aperture and is glued by way of these ledges to the material surrounding aperture 45 in channel 15. The lens ramp 29 has a flat portion 63 at the top which conforms with platform 31, and a sloping portion 59 through which light is transmitted to water flowing down the ramp surface to the bottom 34 of channel 15, thereby providing a smooth flow path for the water from the chamber above platform 31 to the flow channel 15.

What is claimed is:

1. In combination with a spa with a circulating system and a top rim having an outside and inside edge, the improvement being a waterfall structure comprising:

an open water flow channel having a channel floor, side walls, a first end that is closed and a second end that is open, the side walls being longer than the ends, the ends being no longer than the distance between the outside and inside edge of the top rim of the spa, the channel being embedded in the top rim of the spa with the side walls of the water flow channel being between the outside and inside edge of the top rim of the spa, and the second open end of the water flow channel located at the inside edge of the top rim of the spa; and a water access apeture in the channel floor of the open water flow channel at the closed end, allowing water to flow into the channel, at the closed end, and along the channel to the open end, spilling over the inside edge of the top rim into the spa.

2. The waterfall structure of claim 1 wherein the water flow channel has an aperture in the channel floor at the first end of the channel, and further comprising:

a light transmitting lens in the floor of the channel, covering the aperture whereby water from the water access aperture flowing into the channel passes over the lens and picks up light energy passing through it.

3. The waterfall structure of claim 2 further comprising:

a plurality of flow ribs located on the channel floor for guiding the water flow in a laminar manner along the length of the channel.

4. The waterfall structure of claim 3 further comprising:

a disruptor button having a height and a circumference, located at the second end of the channel for disturbing the laminar water flow as it exits the channel and spills into the spa.

5. The waterfall structure of claim 4 wherein all the parts of the waterfall structure are made of plastic.

6. The waterfall structure of claim 5 wherein water from the circulating system of the spa is supplied to the water access aperture of the waterfall structure.

7. The waterfall structure of claim 2 further comprising:

a cap, having a front and back, with a skirt around the back, the cap located over the water access aperture in the channel floor, at the first end, directing water from the access aperture to flow over the lens in the floor of the channel.

8. The waterfall structure of claim 7 wherein the lens floor seals the aperture in the channel floor.

* * * * *